US009057551B2

(12) United States Patent
Jendrusch

(10) Patent No.: US 9,057,551 B2
(45) Date of Patent: Jun. 16, 2015

(54) ICE DISPENSING SYSTEM HAVING A REVERSIBLE CONVEYER

(75) Inventor: Holger Jendrusch, Rot an der Rot (DE)

(73) Assignee: Liebherr-Hausgerate Ochsenhausen GmbH, Ochsenhausen (DE)

( * ) Notice: Subject to any disclaimer, the term of this patent is extended or adjusted under 35 U.S.C. 154(b) by 1654 days.

(21) Appl. No.: 12/287,241

(22) Filed: Oct. 7, 2008

(65) Prior Publication Data

US 2009/0139256 A1 Jun. 4, 2009

(30) Foreign Application Priority Data

Oct. 8, 2007 (DE) ..... UM20 2007 014 027

(51) Int. Cl.

| | |
|---|---|
| ***F25C 5/18*** | (2006.01) |
| ***F25C 5/00*** | (2006.01) |
| *F25C 5/04* | (2006.01) |

(52) U.S. Cl.
CPC ..... *F25C 5/005* (2013.01); *F25C 5/046* (2013.01); *F25C 2500/08* (2013.01)

(58) Field of Classification Search
CPC ... F25C 5/007; F25C 2500/08; F25C 2600/02
USPC ..... 62/344, 381
See application file for complete search history.

(56) References Cited

U.S. PATENT DOCUMENTS

| | | | | |
|---|---|---|---|---|
| 3,329,223 | A * | 7/1967 | Swanson et al. | 177/80 |
| 4,084,725 | A | 4/1978 | Buchser | |
| 2007/0084230 | A1 | 4/2007 | Krause et al. | |

* cited by examiner

*Primary Examiner* — Lakiya Rogers
(74) *Attorney, Agent, or Firm* — Dilworth & Barrese, LLP

(57) ABSTRACT

The present invention relates to a refrigerator and/or freezer with an ice cube maker and with conveying means for conveying the ice cubes, wherein the conveying means are configured such that they are operable in different conveying directions.

19 Claims, 1 Drawing Sheet

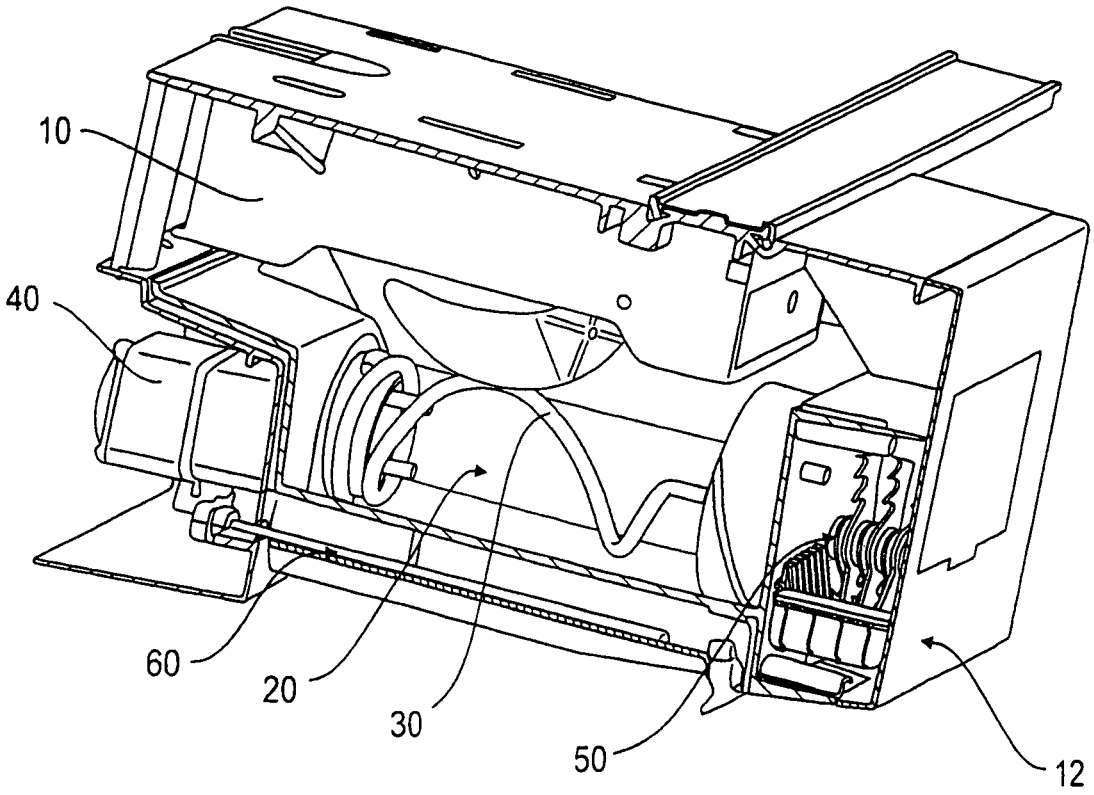
10
40
60
20
30
50
12

ICE DISPENSING SYSTEM HAVING A REVERSIBLE CONVEYER

The present invention relates to a refrigerator and/or freezer with an ice cube maker and with conveying means for conveying the ice cubes.

BACKGROUND OF THE INVENTION

From the prior art, refrigerators and/or freezers are known, which include a so-called ice cube maker. With these appliances, the user can for instance take an ice cube or possibly also water, if desired, via a dispenser provided in the door of the appliance.

Once the ice cubes are made, they are usually first stored in a storage tray, until they are removed from the same upon request of the user, possibly after being crushed.

One disadvantage of the appliances known from the prior art consists in that the ice cubes stick together in particular when they lie in the storage tray for an extended period. Thus, when the ice cubes are stored for an extended period in such appliances known from the prior art, it may happen that they agglomerate due to sublimation processes. By rotating the conveying means, which can be configured for instance in the form of a conveying screw, these agglomerated ice cubes must now be separated, which sometimes succeeds only to a limited extent and above all involves the disadvantage that the drive motor for separating the ice cubes must be designed for comparatively high driving torques.

SUMMARY OF THE INVENTION

Therefore, it is the object underlying the present invention to develop a refrigerator and/or freezer as mentioned above such that the agglomeration of ice cubes can be prevented in a simple way.

This object is solved by a refrigerator and/or freezer with the features herein.

Accordingly, it is provided that the conveying means are configured such that they are operable in different conveying directions.

If the conveying means for instance are a conveying screw, it is provided in accordance with the invention that the same can be operated both in the usual conveying direction and in the reverse conveying direction. It was found that such reversal of the conveying direction leads to thorough mixing of the ice cubes and largely or completely prevents said agglomeration. An essential advantage consists in that the ice cubes hence must no longer be separated, i.e. the motor must only be designed for a comparatively low driving torque.

The ice cube maker can include a receptacle and means for crushing ice cubes, wherein the conveying means are configured such that they deliver the ice cubes from the receptacle in the usual conveying direction into the means for crushing ice cubes. These means for crushing ice cubes can for instance be provided in the form of a crushing mechanism, which crushes the ice cubes supplied to the same into smaller fragments. Such crushing mechanism can consist for instance of a plurality of knives, some of which are stationary and some of which are rotatable.

In a preferred aspect of the invention it is provided that for the conveying means and for the means for crushing ice cubes a common drive motor is provided. In accordance with the invention, this drive motor can be designed for the driving torque necessary for crushing the ice cubes in the crushing mechanism, as higher driving torques do not occur. This is due to the fact that driving torques for separating ice cubes by the conveying means do not occur, as their agglomeration can substantially or completely be prevented in accordance with the invention.

In a further aspect of the invention it is provided that the conveying means are configured such that they are operated at specified times and/or for a specified period in a conveying direction reversed with respect to the usual conveying direction. Thus, it is conceivable for instance that the conveying means are operated per unit time, e.g. once per hour, for a specified time period in a conveying direction reversed relative to the usual conveying direction, so that the ice cubes are thoroughly mixed and prevented from agglomerating. The time intervals and/or the time period, in which this reverse conveying direction is chosen, can be firmly specified or also be adjustable by the user of the appliance.

In a further aspect of the invention it is provided that the conveying means are configured such that in dependence on one or more parameters they are operated in a conveying direction reversed with respect to the usual conveying direction. In this aspect of the invention it is provided that a particular parameter is detected and that in dependence on the parameter detected a reversal of the conveying direction is effected.

It is conceivable, for instance, that the parameter is the amount of ice cubes. Thus, it is conceivable to check whether or how many ice cubes are present in the receptacle of the arrangement and to correspondingly decide whether and/or how long the reversal of the conveying direction is required.

If, for instance, only very few ice cubes are present in the storage tray, it may be sufficient to perform a reversal of the conveying direction only comparatively rarely or not at all. However, if the storage tray is largely or completely filled, it may be provided to perform a reversal of the conveying direction comparatively frequently and/or for a long period, in order to prevent the ice cubes from agglomerating.

In principle, a reversal of the conveying direction thus can be performed in dependence on the amount or weight of the ice cube in the receptacle or of the filling level in the receptacle for the ice cubes made.

In a further aspect of the invention it is provided that the parameter is a time period which has elapsed since the last delivery of ice cubes. This aspect of the invention is based on the knowledge that the probability for the agglomeration of ice cubes is increasing with the time period in which the ice cubes are stored. If only a very short time period has elapsed since the last delivery, it may be provided that a reversal of the conveying direction initially is prevented. Only if a certain limit value of time is exceeded, it may be provided that then for instance for a predetermined time period an operation in reverse conveying direction is performed.

The conveying means can for instance be a conveying screw, whose direction of rotation is variable in accordance with the invention. However, the invention is not limited to a conveying screw, as other conveying means can also be used, as long as they are suited to prevent an agglomeration of the ice cubes by a reversal of their conveying direction.

BRIEF DESCRIPTION OF THE DRAWING

Further details and advantages of the invention will be explained in detail with reference to an embodiment illustrated in the only drawing.

DESCRIPTION OF THE PREFERRED EMBODIMENT

In a schematic perspective representation, the FIGURE shows an ice cube maker in accordance with the present invention.

The ice cube maker includes a unit 10 for making ice cubes. This unit 10 is provided with a water connection, which is not shown in detail in the FIGURE. Reference numeral 12 designates a front-side cover of the ice cube maker.

Below the unit 10, the receptacle 20 or the storage tray is provided, into which the ice cubes made in the unit 10 will fall. The ice cubes are stored in the storage tray 20, until they are removed or crushed upon request of the user of the appliance.

As can furthermore be taken from the FIGURE, the conveying screw 30 is arranged in the vicinity of the storage tray 20, which can be rotated by means of the drive motor 40. The drive motor 40 is an electric motor, which operates the conveying screw in the usual conveying direction, when ice cubes are to be crushed or removed.

Reference numeral 50 designates a so-called crushing mechanism, which consists of stationary and rotating knives and whose function it is to crush the ice cubes delivered into the unit 50 by means of the conveying screw 30.

The crushed ice cubes then are discharged via a dispenser provided for instance in the front side of the door of the appliance.

Reference numeral 60 designates a safety switch, which prevents the crushing mechanism 50 from being operated with open door.

The motor 40 is configured such that it is operable in two directions of rotation. In the normal conveying direction, the conveying screw 30 is operated such that the ice cubes are delivered from the storage tray 20 to the crushing mechanism 50. In the reverse direction of rotation, no delivery is effected, but a thorough mixing of the ice cubes in the storage tray 20, which ultimately leads to the fact that an agglomeration of the ice cubes contained therein is prevented.

This provides the advantage that the ice cubes must no longer be separated and that the motor 40 must only be designed for the actually required driving torque, which is produced for crushing the ice cubes in the crushing mechanism 50.

In the embodiment shown here, the drive motor 40 is used both for driving the conveying screw 30 and for driving the crushing mechanism 50. In principle, arrangements are also conceivable in which a first drive motor is used for operating the conveying means and a second drive motor is used for operating the crushing unit.

Furthermore, it is conceivable that there is not used a motor with two different directions of rotation, but that the reversal of the conveying direction of the conveying means is achieved by a transmission which depending on the position of the transmission converts always the same direction of rotation of the motor into different conveying directions of the conveying means.

The ice cube maker is usable for instance in appliances with an ice or water dispenser arranged in the door. The invention is, however, not limited to such appliances.

The invention claimed is:

1. A system with an ice cube maker and with conveying means for conveying the ice cubes for use in a refrigerator and/or freezer, wherein the conveying means are configured such that they are operable in different conveying directions, and wherein the conveying means are configured such that they are operated in the direction reversed with respect to the first conveying direction based on a period of time which has elapsed since the last delivery of ice cubes.

2. The system according to claim 1, wherein the ice cube maker includes a receptacle (20) and means for crushing ice cubes, and the conveying means are configured such that they deliver the ice cubes from the receptacle (20) in the first conveying direction into the means for crushing ice cubes.

3. The system according to claim 1, wherein for the conveying means and means for crushing ice cubes, a common drive motor (40) is provided.

4. The system according to claim 1, wherein the conveying means are configured such that they are operated at specified times and/or for a specified period in a conveying direction reversed with respect to the first conveying direction.

5. The system according to claim 1, wherein the conveying means are configured such that they are operated in the direction reversed with respect to the first conveying direction in dependence on one or more parameters.

6. The system according to claim 5, wherein the parameter is the amount of ice cubes present in the receptacle (20).

7. The system according to claim 1, wherein the conveying means are a conveying screw (30).

8. The system according to claim 2, wherein for the conveying means and means for crushing ice cubes, a common drive motor (40) is provided.

9. The system according to claim 8, wherein the conveying means are configured such that they are operated at specified times and/or for a specified period in the direction reversed with respect to the first conveying direction.

10. The system according to claim 2, wherein the conveying means are configured such that they are operated at specified times and/or for a specified period in the direction reversed with respect to the first conveying direction.

11. The system according to claim 3, wherein the conveying means are configured such that they are operated at specified times and/or for a specified period in the direction reversed with respect to the first conveying direction.

12. The system according to claim 11, wherein the conveying means are configured such that they are operated in the direction reversed with respect to the first conveying direction in dependence on one or more parameters.

13. The system according to claim 10, wherein the conveying means are configured such that they are operated in the direction reversed with respect to the first conveying direction in dependence on one or more parameters.

14. The system according to claim 9, wherein the conveying means are configured such that they are operated in the direction reversed with respect to the first conveying direction in dependence on one or more parameters.

15. The system according to claim 8, wherein the conveying means are configured such that they are operated in the direction reversed with respect to the first conveying direction in dependence on one or more parameters.

16. The system according to claim 15, wherein the parameter is the amount of ice cubes present in the receptacle (20).

17. The system according to claim 14, wherein the parameter is the amount of ice cubes present in the receptacle (20).

18. The system according to claim 13, wherein the parameter is the amount of ice cubes present in the receptacle (20).

19. The system according to claim 12, wherein the parameter is the amount of ice cubes present in the receptacle (20).

* * * * *